US007020906B2

(12) United States Patent
Cuffari, Jr. et al.

(10) Patent No.: US 7,020,906 B2
(45) Date of Patent: Apr. 4, 2006

(54) TWO PART DOCKING AND FILLING STATION FOR PRESSURIZED CONTAINERS

(75) Inventors: Frederick Cuffari, Jr., Russell, OH (US); Deborah A. Vermillion, Strongsville, OH (US); Ingrid S. Jonsson, Lidingo (SE); Mats Dhanvin Zoroaster Hvalgren, Lidingo (SE); Bernard Dessole, Freneuse (FR); Mauricio Eslava C., Bogata (CO); Jeffrey Rex Winegar, Charlotte, NC (US); Christopher G. Patterson, Roswell, GA (US); Robert W. Stauder, Strongsville, OH (US)

(73) Assignee: LifeGas, LLC, Norcross, GA (US)

( * ) Notice: Subject to any disclaimer, the term of this patent is extended or adjusted under 35 U.S.C. 154(b) by 0 days.

(21) Appl. No.: 10/813,325

(22) Filed: Mar. 30, 2004

(65) Prior Publication Data

US 2004/0194853 A1 Oct. 7, 2004

Related U.S. Application Data

(60) Provisional application No. 60/459,847, filed on Apr. 2, 2003.

(51) Int. Cl.
*B65B 1/04* (2006.01)

(52) U.S. Cl. ..... 4/231; 4/237; 4/18

(58) Field of Classification Search ..... 141/231, 141/237, 239, 36, 133, 164, 279, 130, 369, 141/378, 2, 3, 18, 20, 67; 222/608; 422/100–102
See application file for complete search history.

(56) References Cited

U.S. PATENT DOCUMENTS

| | | | | |
|---|---|---|---|---|
| 3,785,412 | A * | 1/1974 | Stone | 141/83 |
| 4,411,295 | A * | 10/1983 | Nutter | 141/59 |
| 5,226,462 | A * | 7/1993 | Carl | 141/1 |
| 5,954,099 | A * | 9/1999 | Princiotta et al. | 141/18 |
| 6,039,211 | A * | 3/2000 | Slater et al. | 222/1 |
| 6,412,523 | B1 * | 7/2002 | Brozell et al. | 141/2 |
| 6,450,515 | B1 * | 9/2002 | Guth | 280/79.11 |
| 6,684,915 | B1 * | 2/2004 | Ver Hage | 141/2 |

* cited by examiner

*Primary Examiner*—Khoa D. Huynh
(74) *Attorney, Agent, or Firm*—Pearne & Gordon LLP

(57) ABSTRACT

An arrangement and associated method for moving and filling multiple storage containers with pressurized contents. The arrangement includes a movable rack for receiving the multiple containers. The rack includes ground-engaging movable members for permitting the rack and the multiple containers received thereon to be moved. The arrangement includes a fixed filling station that has a plurality of dispensing devices. Each dispensing device is engagable with a storage container to provide the pressurized contents to the containers. The rack and the filling station are arranged such that the rack is movable into proximity with the filling station and the rack is movable away from the filling station. The dispensing devices are arranged within the filling station such that each container is in proximity to a respective device when the rack and the filling station are in proximity. Also, an arrangement and method for moving and filling different types of storage containers.

15 Claims, 6 Drawing Sheets

TWO PART DOCKING AND FILLING STATION FOR PRESSURIZED CONTAINERS

RELATED APPLICATION

Benefit of priority of Provisional Patent Application Ser. No. 60/459,847 filed Apr. 2, 2003 is claimed and the disclosure is incorporated herein by reference.

FIELD OF THE INVENTION

The present invention relates to filling multiple containers with pressurized contents. The present invention specifically relates to an arrangement for filling multiple containers in an expedient manner.

BACKGROUND OF THE INVENTION

In the art of suppling pressurized materials, such as compressed gas, it is known to fill smaller containers (e.g., tanks) from a larger bulk source. Often, there are a great number of smaller containers that are to be filled from a bulk source. Accordingly, the amount of manual labor tends to increase proportionately to an increase in the number of containers that are to be filled.

Also, various other steps are involved in a process of the filling of containers. For example, the containers must be evacuated and cleaned prior to filling, and the containers must be sealed, secured, and labeled subsequent to filling. Also, the containers often must be handled between such process steps (e.g., moving the containers among process step locations). Similar to the filling step itself, the amount of manual labor typically increases for such other steps proportionately to an increase in the number of containers that are to be filled.

SUMMARY OF THE INVENTION

The following presents a simplified summary of the invention in order to provide a basic understanding of some aspects of the invention. This summary is not an extensive overview of the invention. It is intended to neither identify key or critical elements of the invention nor delineate the scope of the invention. Its sole purpose is to present some concepts of the invention in a simplified form as a prelude to the more detailed description that is presented later.

In accordance with one aspect, the present invention provides an arrangement for moving and filling multiple storage containers with pressurized contents. The arrangement includes a movable rack for receiving the multiple containers. The rack includes ground-engaging movable members for permitting the rack and the multiple containers received thereon to be moved. The arrangement includes a fixed filling station that has a plurality of dispensing devices. Each dispensing device is engagable with a storage container to provide the pressurized contents to the containers. The rack and the filling station are arranged such that the rack is movable into proximity with the filling station and the rack is movable away from the filling station. The dispensing devices are arranged within the filling station such that each container is in proximity to a respective dispensing device when the rack and the filling station are in proximity.

In accordance with another aspect, the present invention provides a method for moving and filling multiple storage containers with pressurized contents. The multiple containers are placed onto a movable rack. The rack and the containers thereon are moved into proximity of a fixed filling station via operation of ground-engaging movable members of the rack. Each of the containers is engaged to a respective dispensing device of a plurality of the dispensing devices to provide the pressurized contents to the containers. The containers are disengaged from the respective dispensing devices. The rack is moved away from the filling station with the containers remaining on the rack.

In accordance with another aspect, the present invention provides an arrangement for moving and filling multiple storage containers of different types with pressurized contents. The arrangement includes a first holding device for receiving a first type group of the multiple containers and movable to permit the first holding device and the containers received thereon to be moved, and a second holding device for receiving a second type group of the multiple containers and movable to permit the second holding device and the containers received thereon to be moved. The arrangement includes a fixed filling station having a plurality of dispensing devices, each engagable with a storage container to provide the pressurized contents to the container. The first and second holding devices and the filling station are arranged such that each of the first and second holding devices is movable into proximity with the filling station and movable away from the filling station. The first holding device includes ground-engaging movable members for permitting the first holding device and the multiple containers received thereon to be moved.

In accordance with yet another aspect, the present invention provides a method for moving and filling multiple storage containers with pressurized contents. A first group of the multiple containers is placed onto a first holding device. The first holding device and the containers thereon are moved into proximity of a fixed filling station. Each of the containers on the first holding device is engaged to a respective dispensing device of a plurality of the dispensing devices to provide the pressurized contents to the containers. The containers are disengaged from the respective dispensing devices. The first holding device is moved from the filling station with the containers on the first holding device remaining on the first holding device. A second group of the multiple containers is placed onto a second holding device. The second holding device and the containers thereon are moved into proximity of a fixed filling station. Each of the containers on the second holding device is engaged to a respective dispensing device of a plurality of the dispensing devices to provide the pressurized contents to the containers. The containers are disengaged from the respective dispensing devices. The second holding device is moved from the filling station with the containers on the second holding device remaining on the second holding device. The steps of moving the first holding device into proximity of the filling station and moving the first holding device from the filling station is via ground-engaging movable members on the first holding device.

BRIEF DESCRIPTION OF THE DRAWINGS

Features and advantages of the present invention will become apparent to those skilled in art to which the present invention relates upon reviewing the following description with reference to the accompanying drawings wherein.

DESCRIPTION OF EXAMPLE EMBODIMENTS

Figure 1:
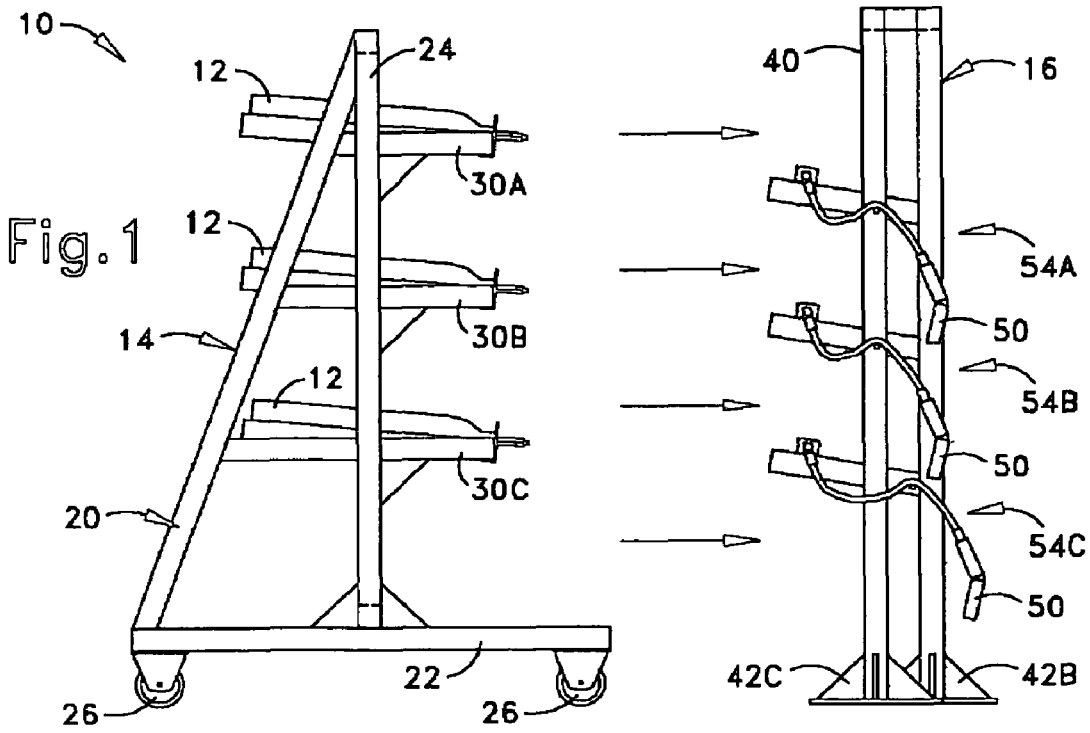
FIG. 1 is a side view illustration of an arrangement in accordance with one aspect of the present invention.

The present invention is described herein with reference to the drawings, wherein like reference numerals are used to refer to like elements throughout. It is to be appreciated that the various drawings are not necessarily drawn to scale from one figure to another nor inside a given figure, and in particular that the sizes of the components are arbitrarily drawn for facilitating the reading of the drawings. In the following description, for purposes of explanation, numerous specific details are set forth in order to provide a thorough understanding of the presented examples of the present invention. However, it is to be appreciated that the present invention may be practiced without these specific details.

An example of an arrangement 10 for moving and filling multiple containers 12 with pressurized contents is shown in FIG. 1. The contents may be compressed gas, liquified gas, liquid, or the like. It is to be appreciated that the shown example of the arrangement is directed for use with an E-type cylinder or tank as the containers 12. However, it is to be appreciated that the present invention is applicable to other types of containers, cylinders, tanks of various shapes, etc. Also, the material that is to be introduced into the containers 12 may have any chemical composition. The material may be in a gaseous form, may be in a liquid form, or the material may be in both phases.

Figure 2:
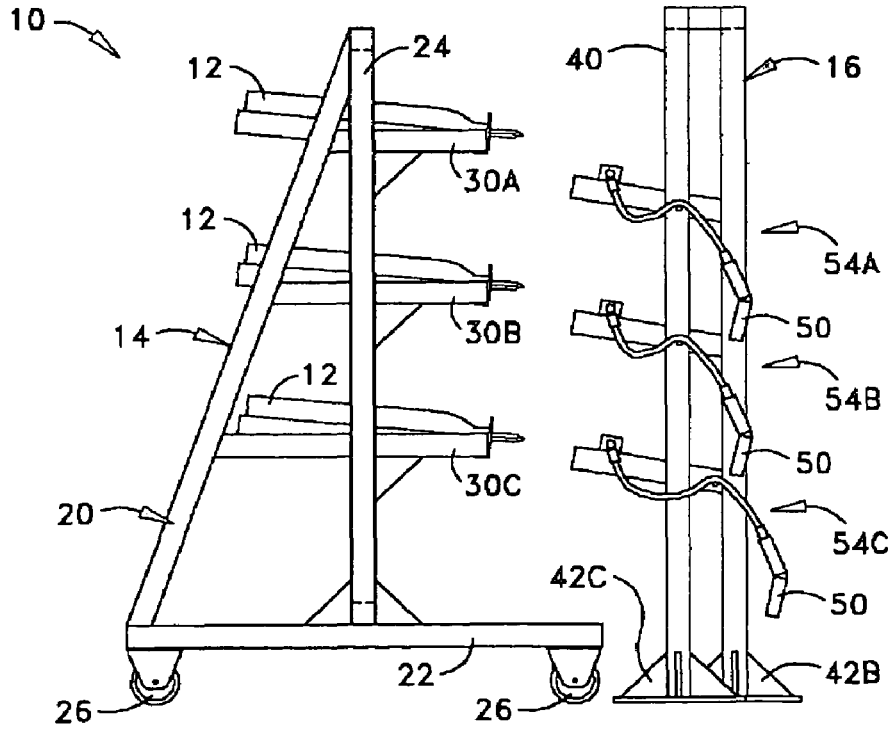
FIG. 2 is an illustration of a view similar to FIG. 1, but showing the arrangement in a different position.
Figure 3:
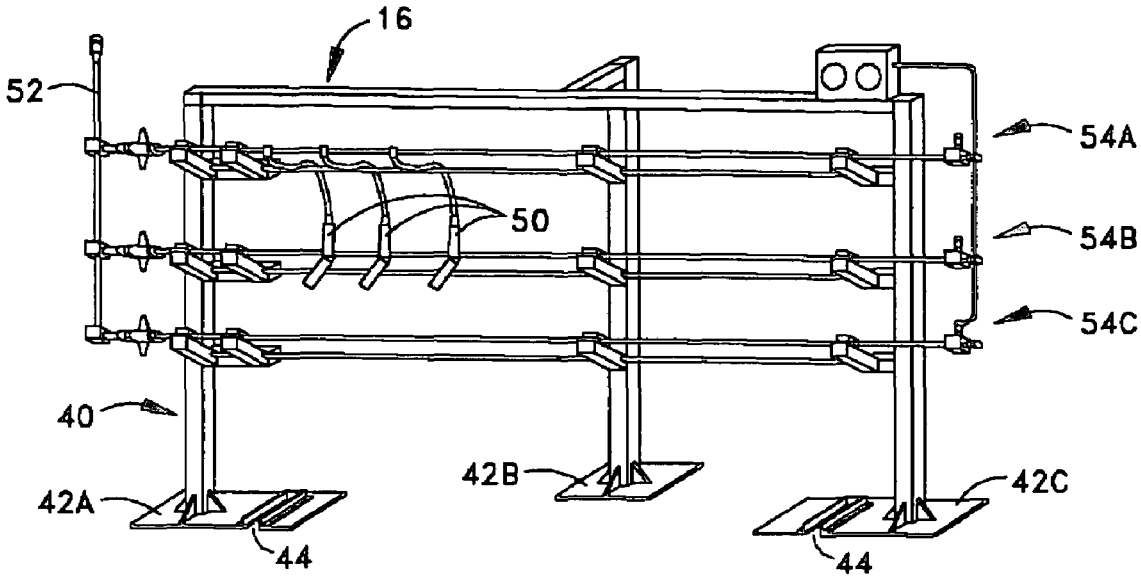
FIG. 3 is a perspective illustration of a fixed-position filling station portion of the arrangement shown in FIG. 1

The arrangement 10 includes two major components. The first component is a movable rack 14 upon which a plurality of the containers 12 are located. The second component of the arrangement 10 is a fixed filling station 16. The rack 14 is movable relative to the filling station 16. A comparison of FIGS. 1 and 2 provides an indication of the movability of the rack 14. FIG. 3 provides an illustrative view of an example of the details of the filling station 16 and FIG. 4 provides an illustrative view of an example of details of the rack 14.

Figure 4:
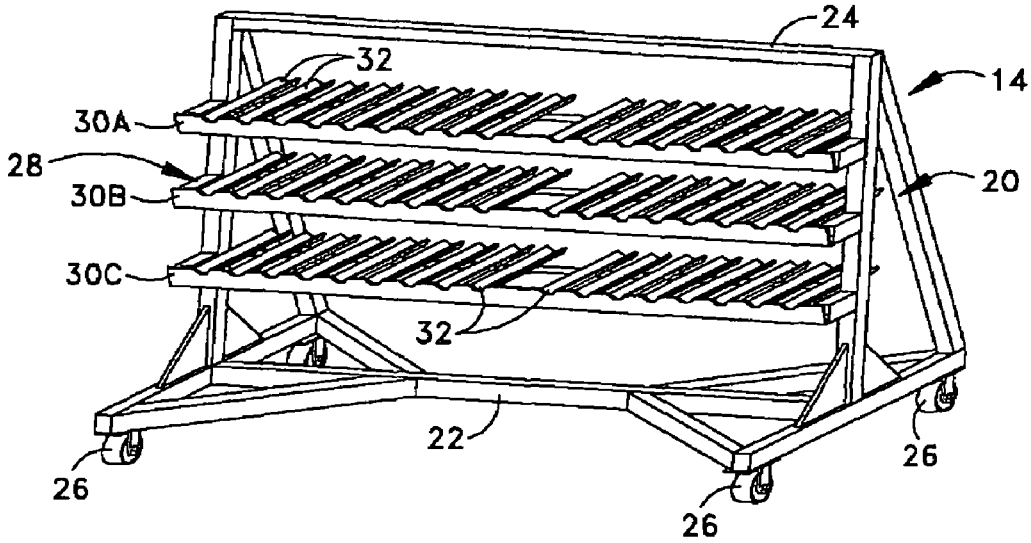
FIG. 4 is a perspective illustration of a mobile rack portion of the arrangement shown in FIG. 1.

Focusing first on the rack 14, attention is directed to FIG. 4. The rack 14 has a frame 20, which includes a lower portion 22 and an upstanding portion 24. Mounted on the bottom of the lower portion 22 are a plurality (e.g., four) of ground-engaging wheels 26. The rack 14 can be wheeled relative to ground by pushing on the rack. It is to be appreciated that the surface which can be considered as ground should be broadly interpreted, however, the ground will typically be a floor (e.g., a floor of a facility). It is to be appreciated that the rack 14 could be moved across other surfaces, such as a floor of a truck bed, which should also be considered to be ground. Also, it is to be appreciated that additional features and structures may be associated with the wheels 26. For example, one or more of the wheels may have an optional feature of a wheel lock that is manually operable (e.g., via a foot switch).

Also, it is to be appreciated that wheels are but one type of ground-engaging members. It is contemplated that other types of ground-engaging members (e.g., tracks, skids, etc.) could be used. Still further, although the show example rack 14 is intended to be movable via manual force, It is to be appreciated that other means of moving the rack (e.g., towing with a motorized vehicle, self propelled) are possible.

Turning to the example structure of the rack 14, the upstanding portion 24 includes supporting structure 28 for supporting a plurality of the containers 12. In the shown example, the supporting structure 28 includes three shelf-like structures 30A–30C. It is to be appreciated that a different number of shelf-like structures is possible. Each shelf-like structure (e.g., 30A) includes a plurality of container locations 32. It is contemplated that the number of container locations 32 may differ from the number shown in the example. The construction of the shelf-like structures 30A–30C and the container locations 32 may have any suitable construction and/or configuration to support the containers. In the illustrated example, each of the container locations 32 is a somewhat trough-like structure that has a neck portion that mates with a neck portion of the containers. However, it is to be appreciated that other structures for providing container locations are contemplated. Such other structures may utilize shelves or may utilize some other construction.

Turning to the filling station 16 (FIG. 3), it is to be appreciated that the filling station is fixed relative to ground (e.g., floor) of the facility within which the arrangement 10 is utilized. The filling station 16 includes an upstanding framework 40 and a plurality of ground-engaging supports 42A–42C upon which the upstanding framework 40 is supported. It is to be appreciated that the supports 42A–42C may be secured to the ground via any suitable means such as bolts, screws, welding, or the like.

Figure 5:
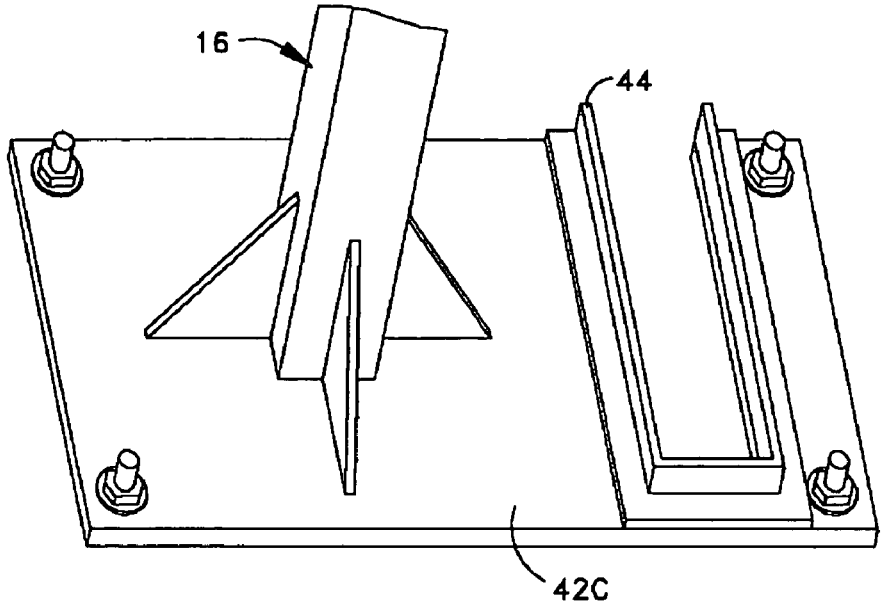
FIG. 5 is an enlarged, reverse angle perspective view of a wheel guide portion of the filling station.
Figure 6:
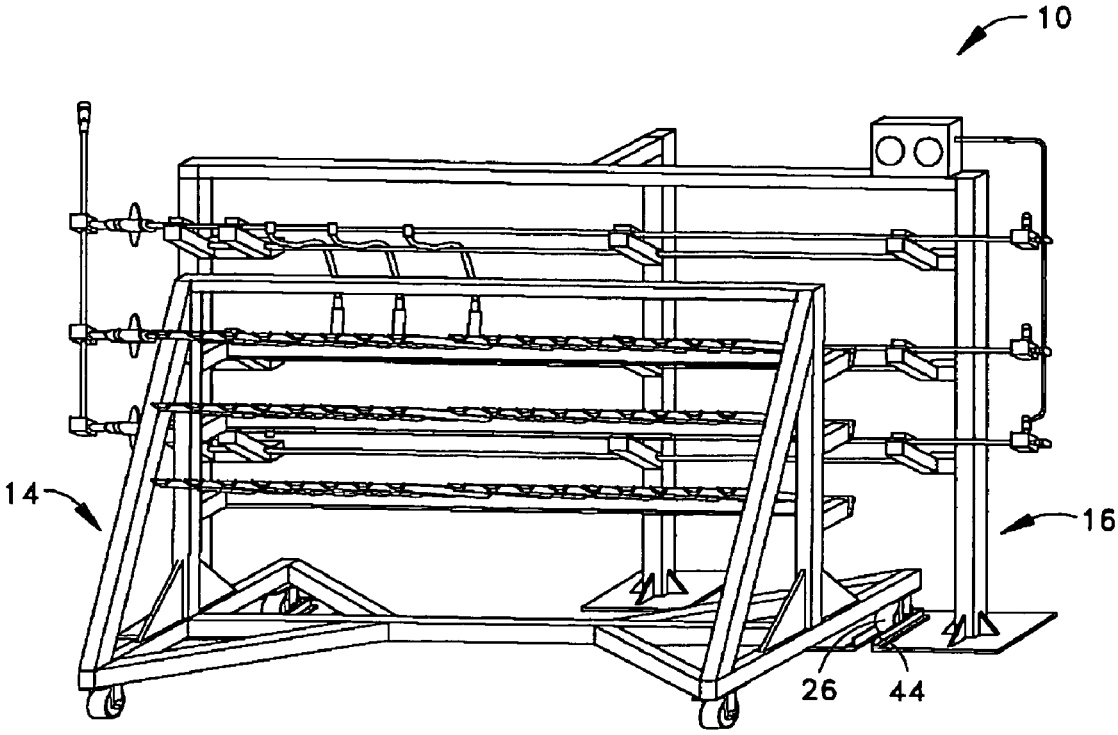
FIG. 6 is a perspective illustration of the rack in a final engagement position with the filling station.

At least one, and possibly more, of the supports (e.g., 42A–42C ) has a wheel receiving arrangement 44 (FIGS. 3 and 5). Specifically, structure is provided to guide, receive, hold, restrain, etc. one or more of the wheels 26 of the rack 14 (See FIG. 6). The structure of the shown receiving arrangement 44 is one example such that positioning of the rack 14 relative to the filling station 16 is an easy and expedient process. It is to be appreciated that different structures, possibly located at a different portion of the filling station 16, and possibly engaging a different portion of the rack 14, are contemplated for guiding, retaining, and the like. Such aspects of guiding, retaining, and the like should be broadly interpreted, and are to be considered as examples of mating of the respective parts of the rack 14 and the filling station 16 when the rack is brought into proximity.

Located on the upstanding framework 40 (FIG. 3) of the filling station 16 are a plurality of dispensing couplings 50 that are connected via suitable lines/piping 52 to a bulk source (not shown) of material (e.g., gas or liquid) that will be delivered as contents to the containers 12. It is to be appreciated that suitable support structure, lines, valving, etc. are also present on the filling station 16 for the dispensing couplings 50. Further, it is to be appreciated that the dispensing couplings 50 are but one type of dispensing device. It is to be appreciated that other devices for providing the pressurized contents are contemplated. In some respects, the type of dispensing device will be related to the type of container and/or the pressurized contents to be provided. As such, dispensing devices are to be broadly interpreted.

Within FIG. 3, only three dispensing couplings 50 are shown to avoid undue drawing confusion within FIG. 3. However, it is to be appreciated that more dispensing couplings are provided. It is contemplated that the number of dispensing couplings 50 will generally be of the same number as the container locations 32 that are present on the rack 14. Further, the dispensing couplings 50 are arranged in an array that generally mimics the array of container locations 32 located on the several shelf-like structures 30A–30C of the rack 14. As such, in the shown example, the dispensing couplings 50 are arranged in three banks 54A–54C, with each bank having a height that is somewhat congruent to the height of the associated shelf-like structures 30A–30C on the rack 14.

With the rack 14 in proximity to the filling station 16, the dispensing couplings 50 are in proximity to the containers 12. In the shown example, the container locations 32 are such that the containers 12 need not be adjusted or removed in order for the rack 14 to be moved into proximity with the filling station 16, in order for the containers 12 to receive the pressurized contents, or in order for the rack to be moved out of proximity with the filling station.

Turning attention to FIGS. 1 and 2, it can be easily appreciated that the rack 14 can be moved relative to the filling station 16 with the multiple containers 12 located thereon. This allows for an expedient movement and control of the multiple containers 12. Further, the movability of the rack 14 permits the containers 12 to be loaded on the rack at a location that is remote from the filling station 16. As such, the containers 12 can be loaded on the rack 14 at a location associated with cleaning and/or evacuation of the containers prior to movement of the movable rack with the containers thereon toward the filling station 16. Also, subsequent to filling of the containers 12 at the filling station 16, the movable rack can be moved, with all of the containers 12 thereon, to a subsequent processing location, such as a location for sealing, securing and labeling the containers. Accordingly, manual loading and unloading of the containers 12 at a plurality of work stations is reduced.

Turning to examples of the uses of the arrangement, it is to be appreciated that various methods are possible. As one example, the rack 14 is initially at a location that is spaced away from the filling station 16 (i.e., remotely located and not proximately located with respect to the filling station). Also, initially, the rack 14 is empty of containers 12. Subsequently, containers 12 are loaded onto the rack 14 at the remote location. The remote location may be associated with a cleaning and/or purging area for the containers 12. As the containers 12 are cleaned and/or purged, the containers are loaded onto the rack 14.

Once the rack 14 is loaded (e.g., either fully or partially, as desired), the loaded rack 14 is moved toward the filling station 16. The movable rack 14, with the containers 12 located thereon, is moved toward a mating interconnection with the filling station 16. Once in proximity, locks, if locks are present on the wheels 26, are secured.

An operator proceeds to connect each of the plurality of dispensing couplings 50 to the respective containers 12. Of course, any level of automation may also be employed. Once all of the dispensing couplings 50 are connected to the respective containers 12, the filling process occurs. It is to be appreciated that various known techniques, structures, etc. are involved in the process of filling multiple containers in batch type approach. As such, details of such procedures and structures are not discussed herein for brevity.

Subsequent to the filling of the containers 12, the dispensing couplings 50 are removed from the containers. Once the filled containers 12 are free from the dispensing couplings 50, the rack 14, now containing full containers is moved away from the filling station 16. It is to be appreciated that another rack 14, containing empty containers 12 may be moved into place to mate with the filling station 16. As such, the structure of the filling station 16 can achieve maximum utilization because individual containers 12 do not need to be loaded at a location of the filling station 16. Plural racks 14 can be distributed/moving around a facility, with only one movable rack being mated against the filling station 16 for service thereat at a time period.

With plural movable racks 14, various different process steps can occur on the containers at various locations other than at the filling station, without needing to remove the containers 12 from the rack. For example, identifying labels can be applied to the filled containers 12 while the containers are still on the rack 14, but after the rack is moved away from the filling station so as to make way for a subsequent rack of containers to be filled. It is to be noted that the containers 12 may remain upon the rack 14 while the movable rack is away from the filling station 16. This indicates the benefit of utilizing the movable rack 14, in that manual loading and unloading is minimized.

It is to be appreciated that the above-discussed example is not the only embodiment that is within the scope of the present invention. Various changes and modifications are possible.

Figure 7:
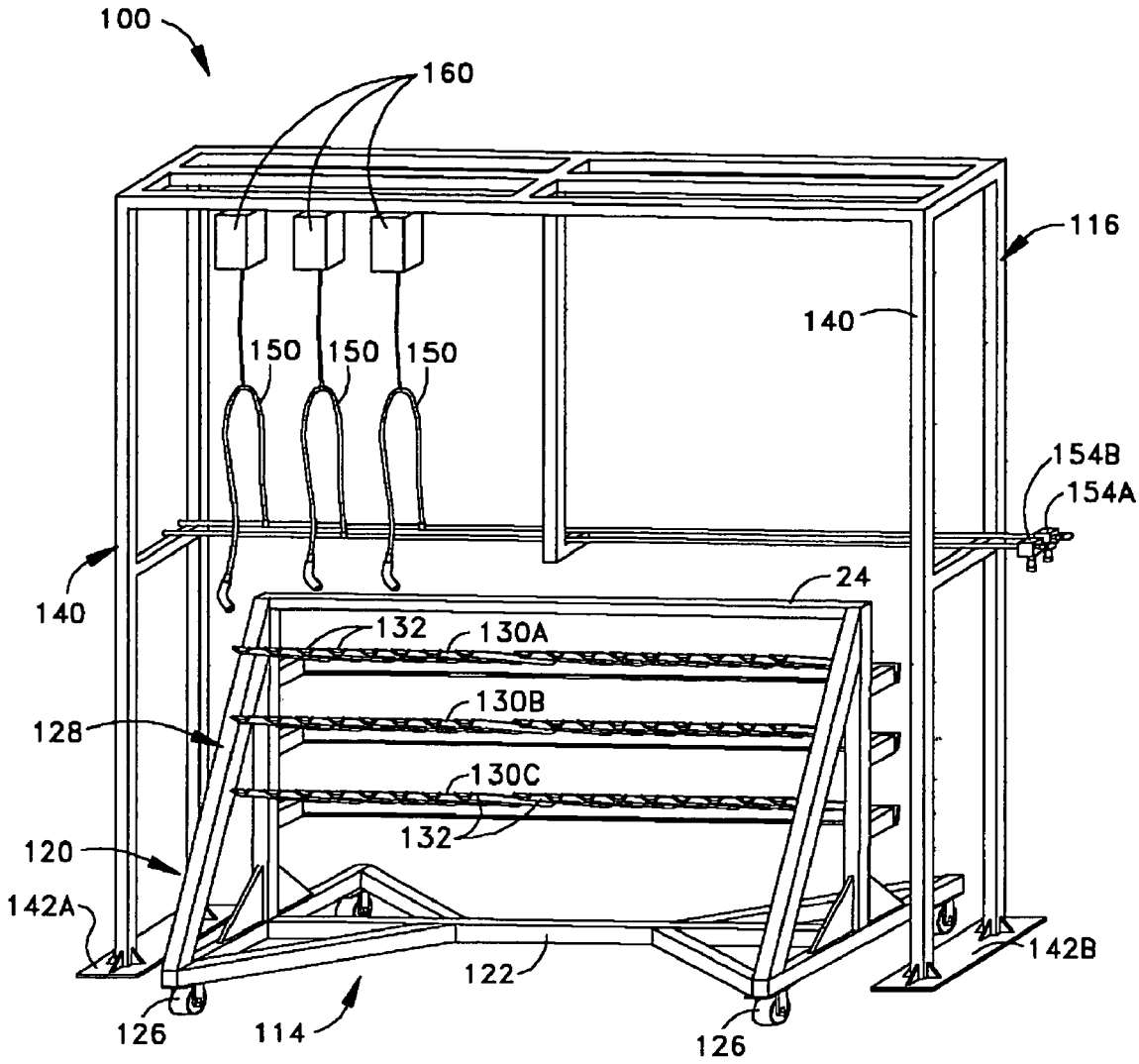
FIG. 7 is a perspective illustration of another arrangement in accordance with another aspect of the present invention.

Turning to FIG. 7, another example of an arrangement 100 is shown. It is to be appreciated that some of the structures of the arrangement 100 are the same as corresponding previously-described structures, and some of the structures of the arrangement are similar to previously described structures. As such, similar reference numerals, but which have an additional "1," are used to describe the arrangement.

Figure 8:
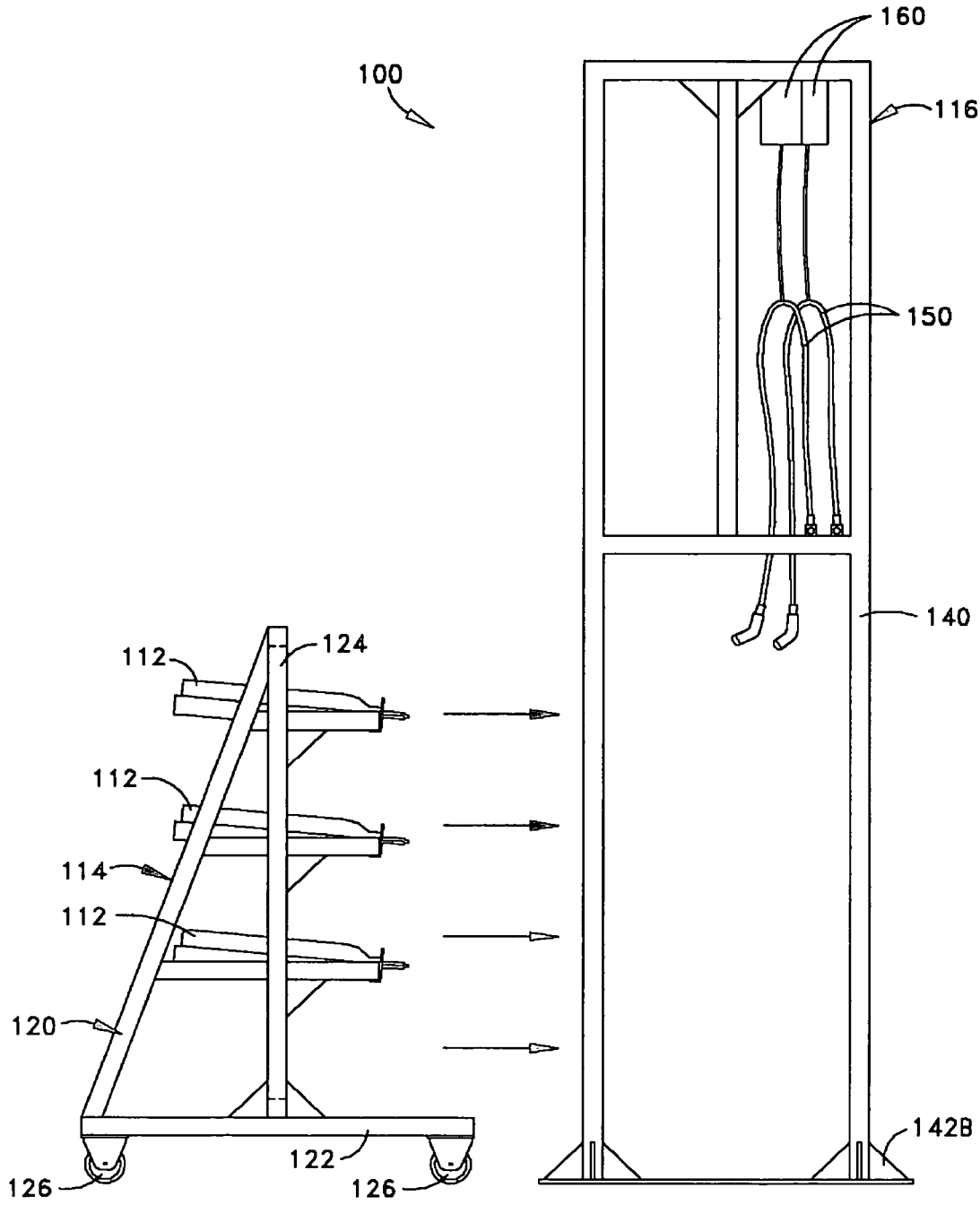
FIG. 8 is side view illustration of the arrangement of FIG. 7 and shows the movement of a mobile rack to a fixed-position fill station.

A rack 114 of the arrangement has a frame 120, which includes a lower portion 122 and an upstanding portion 124. Mounted on the bottom of the lower portion 122 are a plurality (e.g., four) of ground-engaging wheels 126. The rack 114 can be wheeled relative to ground by pushing on the rack. The upstanding portion 124 includes supporting structure 128 for supporting a plurality of the containers 112 (FIG. 8). In the shown example, the supporting structure 128 includes three shelf-like structures 130A–130C, and each shelf-like structure (e.g., 30A) includes a plurality of container locations 132. It is to be appreciated that the various structures (e.g., the wheels 126, and the shelf-like structures 130A–130C) may be varied.

Turning to the filling station 116, it can be appreciated that the filling station of this arrangement 100 (FIGS. 7 and 8) is somewhat different than the filling station 16 (see FIGS. 1–3) of the previous arrangement 10. However, it is to be appreciated that the filling station 116 (FIGS. 7 and 8) is fixed relative to ground (e.g., floor) of the facility within which the arrangement 100 is utilized. The filling station 116 includes an upstanding framework 140 and two ground-engaging supports 142A, 142B upon which the upstanding framework 140 is supported. It is to be appreciated that the supports 142A, 142B may be secured to the ground via any suitable means such as bolts, screws, welding, or the like.

Located on the upstanding framework 140 of the filling station 116 are a plurality of dispensing couplings 150 that are connected to a bulk source (not shown) of material (e.g., gas or liquid) that will be delivered as contents to the containers 112 (FIG. 8). It is to be appreciated that suitable support structure, lines, valving, etc. are also present on the filling station 116 for the dispensing couplings 150. For example, two banks 154A, 154B are shown. Further, it is to be appreciated that the dispensing couplings 150 are but one type of dispensing device. It is to be appreciated that other devices for providing the pressurized contents are contemplated. In some respects, the type of dispensing device will be related to the type of container and/or the pressurized contents to be provided. As such, dispensing devices are to be broadly interpreted.

Within FIG. 7, only three dispensing couplings 150 are shown to avoid undue drawing confusion within FIG. 7, and similarly only two are shown in FIG. 8. However, it is to be appreciated that more dispensing couplings 150 are provided. It is contemplated that the number of dispensing couplings 150 may the same number as the container locations 132 that are present on the rack 114. However, for this arrangement, there need not be a one-to-one correspondence of the number between the container locations 132 and the dispensing couplings 150.

Each of the dispensing couplings 150 are suspended by a retractable holder 160. Specifically, each holder 160 includes a spring-biased tether attached adjacent to ends of the respective coupling 150. Each coupling 150 can be pulled, against the spring bias, to a desired location of the rack 114, and a respective container 112 located thereat. Suitable structure is provided within each holder to maintain the tether at a desired extended length without retraction (e.g., a retraction locking mechanism). Also, it is contemplated that some or all of the holders 160 are movable relative to the framework 140.

As such, with the rack 114 in proximity to the filling station 116, the dispensing couplings 150 are moved into proximity to the containers 112. Similar to the arrangement 10 shown in FIGS. 1, 2, and 6, the containers 112 need not be adjusted or removed in order for the rack 114 to be moved into proximity with the filling station 16, in order for the containers 112 to receive the pressurized contents, or in order for the rack to be moved out of proximity with the filling station. Once filling is complete, the couplings 150 are removed and the tethers of the holders 160 are retracted (e.g., deactivation of the retraction locking mechanism).

It can be easily appreciated that the rack 114 can be moved relative to the filling station 116 with the multiple containers 112 located thereon. This allows for an expedient movement and control of the multiple containers 112. Further, the movability of the rack 114 permits the containers 112 to be loaded and unloaded at a location that is remote from the filling station 116. Also, other process steps can be performed on the containers 112, while the containers are on the rack 114, thus manual loading and unloading of the containers at a plurality of work stations is reduced.

Figure 9:
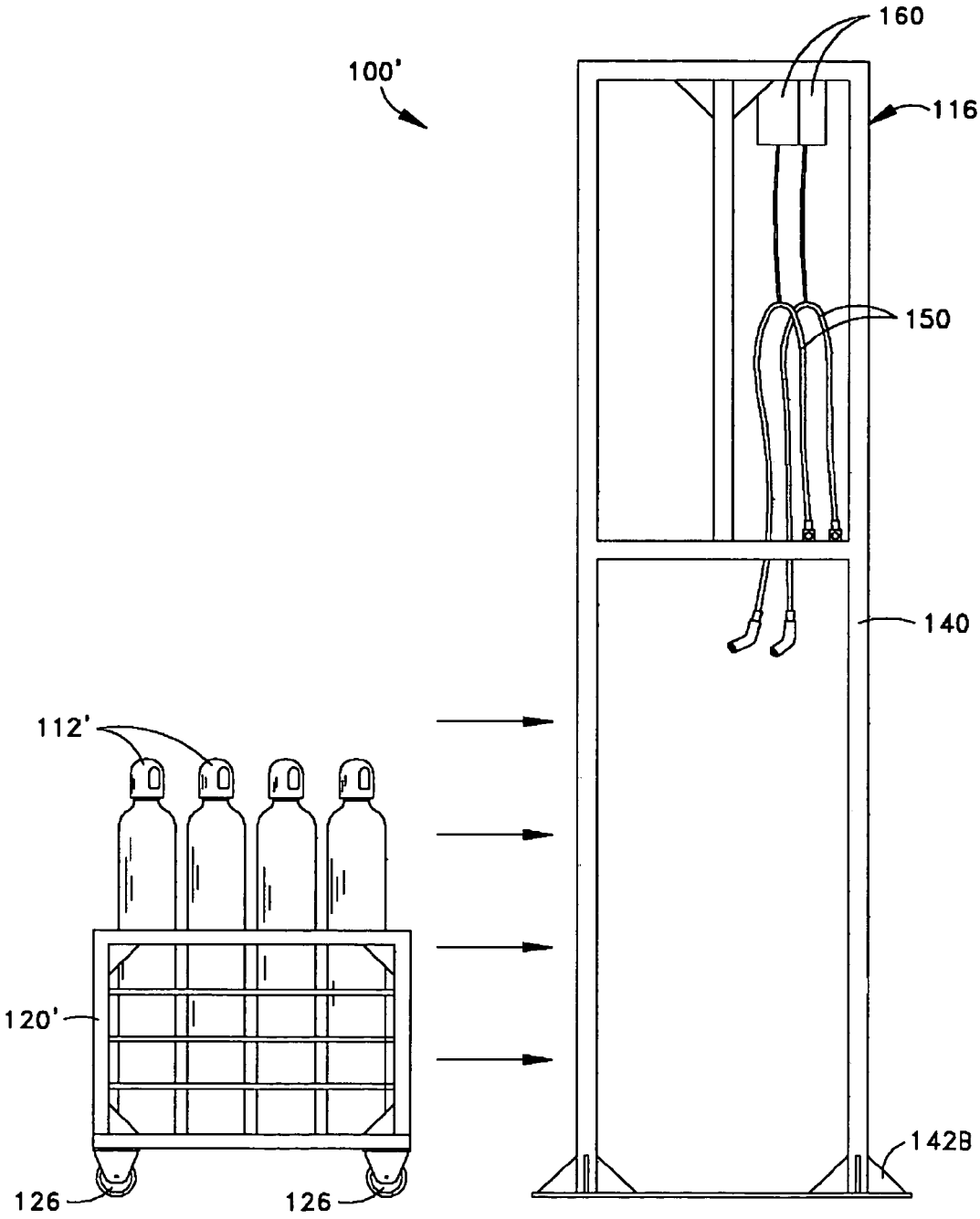
FIG. 9 is view similar to FIG. 8, but shows another device that can also be used with the fixed-position fill station of the arrangement.

Additional benefits are provided by the filling station 116, specifically other types of racks, carts, pallets, etc. (e.g., holding device) can be used with the filling station. Also, different types if containers can be filled. FIG. 9 shows such an example. Specifically, a different type of rack, cart, pallet, or the like that holds containers (e.g., large cylinders) 112' is movable (as shown by arrows) into proximity. Thus, a different arrangement, as designated by the use of the "'" for the arrangement 112' is provided. It is contemplated that the different arrangement 112' may include the different racks, carts, pallets, or the like, and may also include the rack 14 (FIG. 4), and/or the rack 114 (FIG. 7). As such, the shown holding device is to be understood to be any of such structures.

In view of the fact that any type of rack, cart, pallet, or the like can be used, few structural details are discussed. In the shown example, the rack, cart, pallet, or the like has some supporting structure (e.g., a frame 120'). It is to be appreciated that any useful supporting structure 120' is possible. Also in the shown example, the rack, cart, pallet, or the like has a means (e.g., wheels 126') for movement. It is to be appreciated that any means for movement are possible. In particular, the means for movement may be an external device, such as a forklift. Thus, the means for movement would not need to include such structure as the shown wheels 126'.

It is contemplated that because the filling station 100' could be used to fill various types of containers, interchangeable components on the dispensing couplings may be used as needed. It is to be appreciated that because the dispensing couplings 150 are movable, via the extendible holders 160, the rack, cart, pallet, or the like need not have a particular configuration and the couplings are merely brought to the containers 112'.

What has been described above includes exemplary implementations of the present invention. It is, of course, not possible to describe every conceivable combination of components or methodologies for purposes of describing the present invention, but one of ordinary skill in the art will recognize that many further combinations and permutations of the present invention are possible. Accordingly, the present invention is intended to embrace all such alterations, modifications and variations that fall within the spirit and scope of the appended claims.

What is claimed:

1. An arrangement for moving and filling multiple storage containers with pressurized contents, the arrangement including:

a movable rack having a plurality of shelf-like structures, each shelf being vertically arranged with respect to one another and each shelf including a plurality of container locations for receiving the multiple containers;

ground-engaging movable members attached to the movable rack for permitting the movable rack and the multiple containers received thereon to be moved, wherein the movable rack includes a frame having a lower portion and an upstanding portion, the lower portion having the ground-engaging movable members being mounted thereon;

a filling station comprising a fixed rack having a plurality of dispensing devices secured to the fixed rack, each dispensing device being engageable with a storage container to provide the pressurized contents to the multiple containers on the movable rack;

wherein the movable rack and the fixed rack are arranged such that the movable rack is movable via the ground engaging movable members into proximity with and away from the fixed rack, and wherein the dispensing devices are secured to the fixed rack in an array that generally mimics the array of container locations located on the plurality of shelf-like structures such that each container is in proximity to a respective dispensing device when the movable rack and the fixed rack are in proximity, wherein each of the dispensing devices are suspended by a retractable holder, each holder including a spring-biased tether attached to adjacent ends of the respective dispensing device.

2. An arrangement as set forth in claim 1, wherein the containers need not be adjusted or removed from the movable rack while the movable rack is moved into proximity with the fixed rack, the containers receive the pressurized contents, or the movable rack is moved out of proximity with the fixed rack.

3. An arrangement as set forth in claim 1, wherein the movable rack is movable via operation of the ground engaging movable members out of proximity with the fixed rack to a location relatively distant from the fixed rack such that a second movable rack may be moved into proximity with the fixed rack.

4. An arrangement as set forth in claim 1, wherein each of the container locations is adapted to receive a respective container in a substantially horizontal position.

5. An arrangement as set forth in claim 1, wherein the fixed rack includes a plurality of ground-engaging supports that are secured to the ground.

6. An arrangement as set forth in claim 5, wherein the ground-engaging supports includes a wheel receiving arrangement adapted to receive the ground-engaging movable members attached to the movable rack.

7. An arrangement as set forth in claim 1, wherein the movable rack includes at least three shelf-like structures on which the containers are supporting and the fixed rack includes at least three banks in which the dispensing couplings are arranged, with each bank having a height that is congruent to a height of the corresponding shelf-like structure.

8. A method for moving and filling multiple storage containers with pressurized contents, the method including:

placing the multiple containers onto a plurality of container locations provided on a plurality of shelf-like structures of a movable rack, each shelf-like structure being vertically arranged with respect one another;

moving the movable rack and the containers thereon into proximity of a fixed rack via operation of ground-engaging movable members mounted to the movable rack, wherein the movable rack includes a frame having a lower portion and an upstanding portion, the lower portion having the ground-engaging movable members being mounted thereon;

engaging each of the containers to a respective dispensing device of a plurality of the dispensing devices secured to the fixed rack to provide the pressurized contents to the containers, the dispensing devices being arranged in an array on the fixed rack that mimics an array of container locations located on the plurality of shelf-like structures, wherein each of the dispensing devices are suspended by a retractable holder, each holder including a spring-biased tether attached to adjacent ends of the respective dispensing device;

disengaging the containers from the respective dispensing devices; and moving the movable rack away from the fixed rack with the containers remaining on the movable rack.

9. A method as set forth in claim 8, wherein the movable rack includes locations for receiving the containers such that the containers need not be adjusted or removed from the movable rack during the steps of moving the movable rack and the containers thereon, engaging each of the containers to respective dispensing devices, disengaging the containers from the respective dispensing devices, and moving the movable rack away from the filling station with the containers.

10. A method as set forth in claim 8, wherein the step of moving the rack away from the filling station with the containers includes moving the rack out of proximity with the filling station to a location relatively distant from the filling station such that a second movable rack may be moved into proximity with the filling station.

11. A method as set forth in claim 8, wherein the step of moving the movable rack into proximity of a fixed rack includes guiding at least one of the ground-engaging movable members of the movable rack into at least one wheel receiving arrangement located on at least one ground-engaging support coupled to the fixed rack.

12. An arrangement for moving and filling multiple storage containers of different types with pressurized contents, the arrangement including:

a first holding device for receiving a first type group of the multiple containers and movable to permit the first holding device and the containers received thereon to be moved;

a second holding device for receiving a second type group of the multiple containers and movable to permit the second holding device and the containers received thereon to be moved; and a fixed filling station having a plurality of dispensing devices, each engageable with a storage container to provide the pressurized contents to the container, wherein each of the dispensing devices are suspended by a retractable holder, each holder including a spring-biased tether attached to adjacent ends of the respective dispensing device;

wherein the first and second holding devices and the filling station are arranged such that each of the first and second holding devices is movable into proximity with the filling station and movable away from the filling station, and the first holding device includes ground-engaging movable members attached to the first holding device for permitting the first holding device and the multiple containers received thereon to be moved, and wherein the first holding device is configured to hold the first group of the multiple containers on a movable rack with vertically arranged shelf-like structures and the second holding device is configured to hold the second group of the multiple containers on a pallet, wherein the movable rack includes a frame having a lower portion and an upstanding portion, the lower portion having the ground-engaging movable members being mounted thereon.

13. An arrangement as set forth in claim 12, wherein the first holding device and the filling station include parts that mate when the first holding device and the filling station are in proximity.

14. A method for moving and filling multiple storage containers with pressurized contents, the method including:

placing a first group of the multiple containers onto a first holding device;

moving the first holding device and the containers thereon into proximity of a fixed filling station;

engaging each of the containers on the first holding device to a respective dispensing device of a plurality of the dispensing devices to provide the pressurized contents to the containers, wherein each of the dispensing devices are suspended by a retractable holder, each holder including a spring-biased tether attached to adjacent ends of the respective dispensing device;

disengaging the containers from the respective dispensing devices; and moving the first holding device from the filling station with the containers on the first holding device remaining on the first holding device;

placing a second group of the multiple containers onto a second holding device;

moving the second holding device and the containers thereon into proximity of a fixed filling station;

engaging each of the containers on the second holding device to a respective dispensing device of a plurality of the dispensing devices to provide the pressurized contents to the containers;

disengaging the containers from the respective dispensing devices; and moving the second holding device from the filling station with the containers on the second holding device remaining on the second holding device;

wherein the steps of moving the first holding device into proximity of the filling station and moving the first holding device from the filling station is via ground-engaging movable members mounted to the first holding device, and wherein the step of placing the first group of the multiple containers onto the first holding device includes placing the containers on a movable rack having vertically arranged shelf-like structures of the first holding device, wherein the movable rack includes a frame having a lower portion and an upstanding portion, the lower portion having the ground-engaging movable members being mounted thereon, and the step of placing the second group of the multiple containers onto the second holding device includes placing the containers on a pallet structure of the second holding device.

15. A method as set forth in claim 14, wherein the step of moving the first holding device and the containers thereon into proximity of a fixed filling station includes mating parts of the first holding device and the filling station.

* * * * *

UNITED STATES PATENT AND TRADEMARK OFFICE

CERTIFICATE OF CORRECTION

PATENT NO. : 7,020,906 B2
APPLICATION NO. : 10/813325
DATED : April 4, 2006
INVENTOR(S) : Frederick Cuffari, Jr. et al.

It is certified that error appears in the above-identified patent and that said Letters Patent is hereby corrected as shown below:

In Column 9, Lines 20-21, please delete "includes a wheel receiving arrangement" and insert -- include wheel receiving arrangements --.

Signed and Sealed this

Twenty-first Day of November, 2006

JON W. DUDAS
*Director of the United States Patent and Trademark Office*